US009840848B2

(12) United States Patent
Cleavenger, II

(10) Patent No.: US 9,840,848 B2
(45) Date of Patent: Dec. 12, 2017

(54) HANDRAIL MOUNTING ASSEMBLY

(71) Applicant: Laitram, L.L.C., Harahan, LA (US)

(72) Inventor: John F. Cleavenger, II, Westwego, LA (US)

(73) Assignee: Laitram, L.L.C., Harahan, LA (US)

( * ) Notice: Subject to any disclaimer, the term of this patent is extended or adjusted under 35 U.S.C. 154(b) by 0 days.

(21) Appl. No.: 15/414,823

(22) Filed: Jan. 25, 2017

(65) Prior Publication Data

US 2017/0268236 A1 Sep. 21, 2017

Related U.S. Application Data

(60) Provisional application No. 62/286,540, filed on Jan. 25, 2016.

(51) Int. Cl.
*E04F 11/18* (2006.01)
*E04H 17/20* (2006.01)

(52) U.S. Cl.
CPC ..... *E04F 11/1808* (2013.01); *E04F 11/1804* (2013.01); *E04H 17/20* (2013.01)

(58) Field of Classification Search
CPC ..... E04F 11/1804; E04F 11/1808; E04F 11/1838; E04H 2017/1447; E04H 2017/1473
See application file for complete search history.

(56) References Cited

U.S. PATENT DOCUMENTS 3,157,378 A * 11/1964 Blum ..... E04F 11/1836 248/218.4
3,164,354 A * 1/1965 Murdock ..... E04F 11/1804 248/229.1
3,306,585 A * 2/1967 Blum ..... E04F 11/1838 248/251
3,372,909 A * 3/1968 Attaway ..... E04F 11/181 256/21
3,428,300 A * 2/1969 Sconzo ..... E04H 17/1413 256/59
4,102,529 A * 7/1978 Neblung ..... E04F 11/181 248/251
4,650,164 A * 3/1987 Shepherd ..... E04F 11/1804 256/65.16
5,785,447 A * 7/1998 Fonti ..... E04H 17/1413 248/219.4
2008/0209853 A1* 9/2008 Hull ..... E04F 11/1838 52/832

* cited by examiner

*Primary Examiner* — Daniel J Wiley
(74) *Attorney, Agent, or Firm* — Catherine M. Bishop

(57) ABSTRACT

A handrail mounting assembly comprises an adjustable bracket and an orientable bracket arm connected to a handrail seat. The adjustable bracket comprises two mating components that surround a post and lock together using fasteners extending through aligned openings in the two mating components. A bracket arm connected to the handrail seat includes an extending opening that aligns with a threaded opening in the adjustable bracket for receiving a fastener to connect the bracket arm to the bracket.

9 Claims, 2 Drawing Sheets

HANDRAIL MOUNTING ASSEMBLY

RELATED APPLICATIONS

This application claims priority to U.S. Provisional Patent Application Ser. No. 62/286,540, filed Jan. 25, 2016 and entitled Handrail Mounting Assembly, the contents of which are herein incorporated by reference.

FIELD OF THE INVENTION

The invention relates generally to support brackets. More particularly, the invention relates to a support bracket for mounting a handrail.

BACKGROUND

Handrails are conventionally mounted along stairs, ramps, walkways and other areas to provide support for people moving through that area. Conventional handrail mounting systems require drilling of holes in a support structure, such as a wall or a post, making field adjustment difficult and also creating undesirable permanent changes to the support structure.

SUMMARY

An adjustable mounting assembly for mounting a handrail to a support structure comprises an adjustable bracket for mounting to the support structure and an orientable bracket arm for connecting a handrail seat to the adjustable bracket.

According to one aspect, a handrail mounting assembly, comprises an adjustable bracket comprising a first section and a second section coupled to the first section for encircling and mounting to a support structure, a bracket arm connected to the adjustable bracket using a threaded fastener and a handrail seat connected to the bracket arm for seating a portion of a handrail to connect the handrail to the support structure.

According to another aspect, a bracket for mounting a handrail to a post, comprises a first section and a second section. The first section forms an open seat for the post and comprises a base wall, a first side wall extending from and perpendicular to the base wall, a second side wall extending from the base wall and parallel to the first side wall to define the open seat, a plurality of first openings in the first and second side walls and a tapped opening in the base wall. The second section couples to the first section to enclose the open seat. The second section includes a plurality of second openings that align with the first openings to form passageways for receiving fasteners to adjustably connect the first section and the second section.

According to another aspect, a handrail mounting assembly comprises a bracket for attaching to a support structure, the bracket having a threaded through hole in a base wall, a bracket arm comprising a tubular barrel having an opening extending therethrough, a threaded fastener inserted into the opening of the bracket arm, the threaded fastener longer than the opening to that an end of the fastener protrudes from the bracket arm and into a threaded through hole in the bracket and a handrail seat connected to the bracket arm.

According to another aspect, a method of mounting a handrail to a post comprises the steps of attaching an adjustable bracket to the post by sandwiching the post between two sections of the adjustable bracket, tightening the adjustable bracket to set the position of the bracket on the post, orienting a bracket arm relative to the adjustable bracket, tightening the bracket arm to set the orientation of the bracket arm relative to the adjustable bracket, and attaching a handrail to a handrail seat connected to the bracket arm.

DETAILED DESCRIPTION

A handrail mounting assembly can be easily adjusted and assembled. The invention will be described relative to certain illustrative embodiments, though the invention is not limited to the embodiments described herein.

Figure 1:
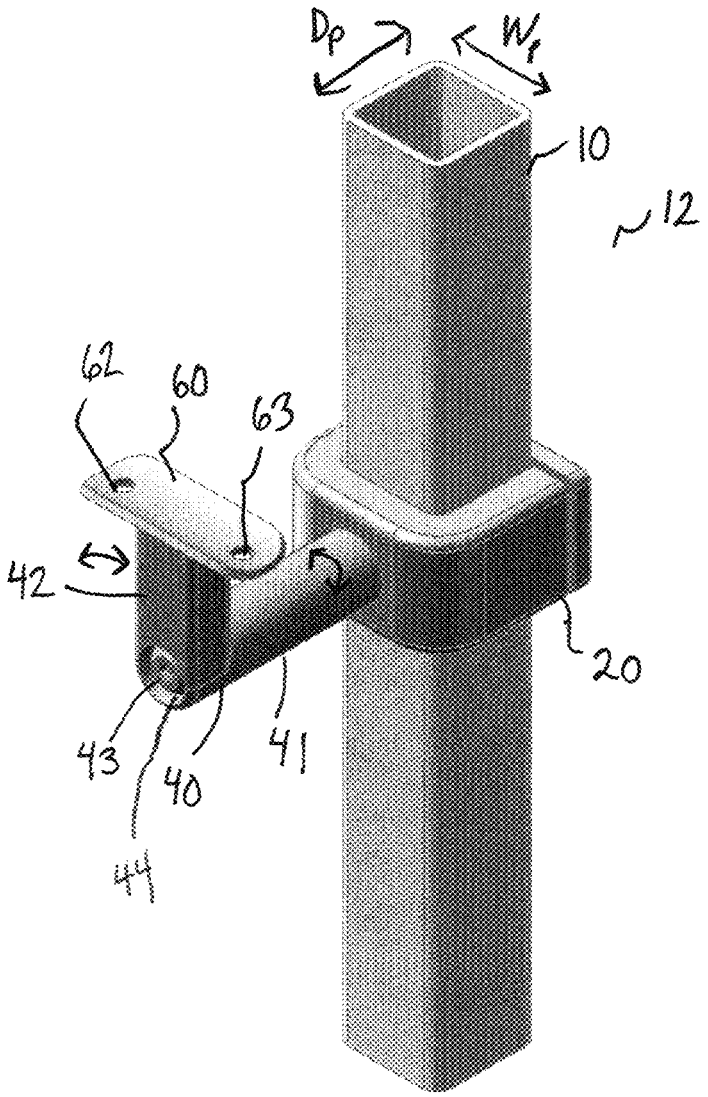
FIG. 1 shows a handrail mounting assembly of one embodiment of the invention.

FIG. 1 shows a handrail mounting assembly 12 for mounting a handrail (not shown) to a post 10 or other support structure. The handrail mounting assembly 12 comprises an adjustable bracket 20, a bracket arm 40 extending from the adjustable bracket 20 and a handrail seat 60 for receiving a handrail to connect the handrail to the post 10. In one embodiment, the adjustable bracket 20 is configured to attach to a square post, thought the invention is not so limited. The bracket 20 can be easily adjusted, as described below. The orientation of the bracket arm 40 can also be adjusted relative to the bracket to allow adjustment of the handrail.

Figure 2:
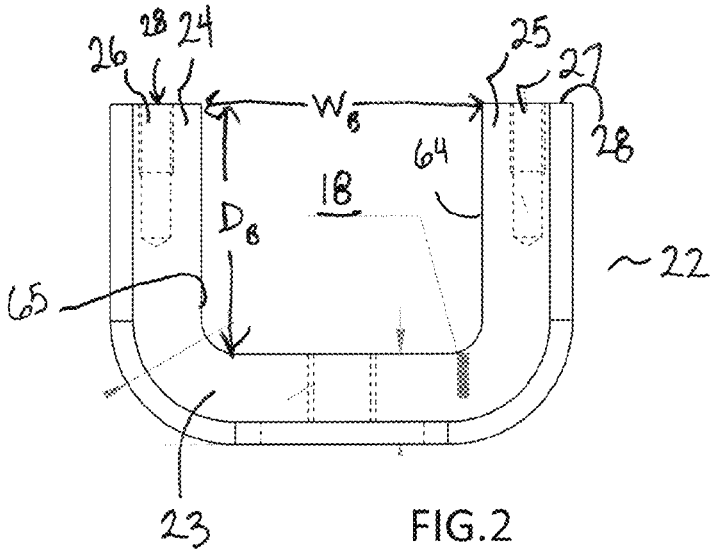
FIG. 2 is a side view of a first section of an adjustable bracket in the handrail mounting assembly of FIG. 1.
Figure 3:
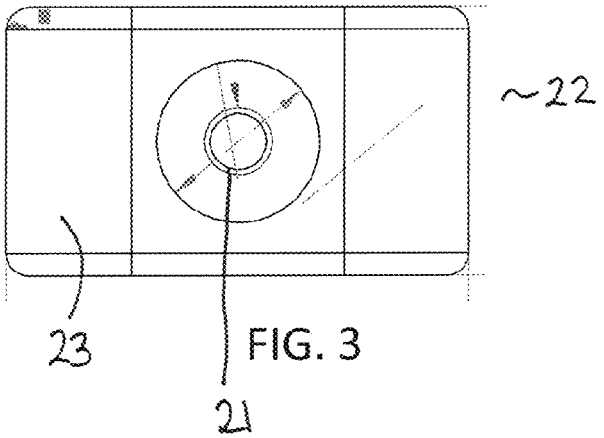
FIG. 3 is an end view of the first section of FIG. 2.
Figure 4:
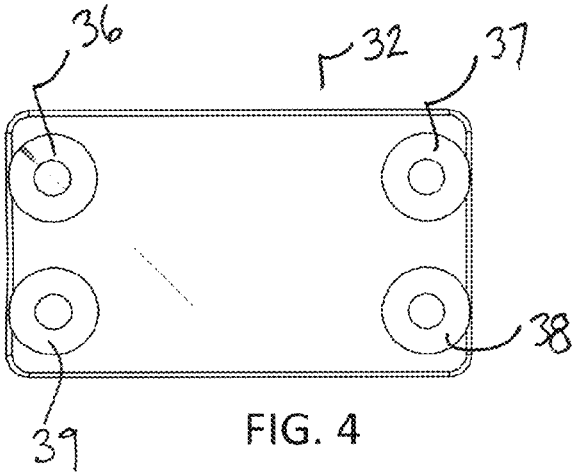
FIG. 4 is an end view of a second section of the adjustable bracket of the handrail mounting assembly of FIG. 1.
Figure 5:
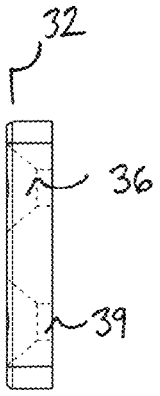
FIG. 5 is a side view of the second section of FIG. 4.

Referring to FIGS. 2-4, the illustrative adjustable bracket 20 comprises a first section 22 that mates with a second section 32 to attach to a post or other support structure. The illustrative first section 22 forms an open seat 18 for the post, comprising a base wall 23, and two side walls 24, 25 extending substantially perpendicular to the base wall 23. Each side wall 24, 25 includes two openings for a total of four openings, two of which, 26, 27 are shown in FIG. 2, for receiving fasteners. The openings 26, 27, are entirely contained within the side walls 24, 25 and are preferably centered between outer and inner surfaces defining the side walls, and are parallel to the inner surfaces 64, 65 of the side walls. The inner surfaces 64, 65 sandwich the post 10 when the bracket is mounted to the post 10. The illustrative side walls 24, 25 are straight and parallel to each other, as are the openings 26, 27. The openings extend into the side walls 24, 25 by a selected distance from the front face 28.

In one embodiment, the width $W_b$ of the first section, the distance between side walls 24, 25, is about equal to the width $W_p$ of the post 10 to allow the post to slide into the space between the side walls. The depth $D_b$ of the bracket seat 18 formed between the side walls is approximately equal to or smaller than the depth $D_p$ of the post.

The base wall 23 also includes an opening 21, which may be a tapped through hole, for connecting the bracket 20 to the bracket arm 40.

The illustrative second section 32 comprises an end plate that spans the opening 18 formed between the two side walls 24, 25. The end plate 32 includes four openings 36, 37, 38, 39 that align with the side wall openings 26-27 to form passageways for receiving a fastener to secure the end plate 32 to the bracket seat 22. On the back side, the openings may be countersunk to accommodate the head of a fastener. The illustrative second section 32 is substantially planar, though alternatively, the second section may have a different shape, such as a u-shape with side walls that match the side walls of the first section.

In one embodiment, the openings 36-39 are slightly larger than the openings 26, 27 in the first section 22.

To mount the bracket 20 to the post 10, the first section 22 is wrapped around the post. The, the second section 32 is placed over the post 10 with the openings 26, 27, 36-39 aligned to surround the post 10. Fasteners, such as screws, are inserted into the passageways to connect the first section 33 to the second section 32. The bracket 20 can be easily adjusted on the post by loosening the fasteners, and the bracket can be secured in place and by tightening the fasteners to lock the post 10 in the bracket seat 18.

Referring back to FIG. 1, the bracket arm 40 comprises a first section 41 and a second section 42 extending at an angle, shown as perpendicular, to the first section 41. The first and second sections may be integral or separately-formed components. The first section comprises a tubular barrel including an opening 44 extending therethrough for a fastener 43 to connect the bracket arm 40 to the adjustable bracket 20. The opening 44 has a seat at a first end of the tubular barrel to limit movement of the fastener 43. The fastener 43 is longer than the opening 44 so that when the fastener head is seated in the seat of the opening 44, the tip of the fastener 43 protrudes from the second end of the first section 41. The protruding end of the fastener is inserted in the opening 21 in the bracket base wall 23 to connect the bracket arm 40 to the bracket 20. The second section 42 of the bracket arm 40 forms a handrail seat connector to connect the handrail seat 60 to the bracket arm 40.

The orientation of the bracket arm 40 relative to the bracket 20 is adjustable. The bracket arm 40 can rotate about the protruding end of the fastener, allowing orientation of handrail seat. After the bracket arm 40 is position in a desired orientation relative to the bracket 20, the fastener 43 is tightened to lock the bracket arm 40 to the bracket 20 in the desired orientation. The fastener 43 can be loosened, and the orientation of the bracket arm changed, followed by re-tightening of the fastener 43 to change the orientation of the bracket arm 40.

The illustrative handrail seat 60 is formed on the top of the second section of the bracket arm 40 and can be integral with the bracket arm 40 or separately-formed and attached. The handrail seat 60 is curved to match the profile of the bottom of a handrail and includes openings 62, 63 to receive fasteners for fastening the rail to the handrail seat 60. The handrail seat can have any suitable configuration for receiving and connecting a handrail to the bracket arm. For example, the handrail seat could be annular, or square to accommodate a square handrail. The handrail can be adjustable relative to the bracket arm 40, if desired.

The illustrative handrail mounting assembly provides increased flexibility and reduced installation time by eliminating the need to drill, tap or punch openings in the post or other support structure in order to mount the handrail. The illustrative handrail mounting assembly allows for easy field adjustment of the assembly and-or handrail mounted thereto by simply loosening the components, adjusting and re-tightening the connections in the desired location and orientation.

The scope of the claims is not meant to be limited to the details of the described exemplary embodiments.

What is claimed is:

1. A handrail mounting assembly, comprising:

an adjustable bracket comprising:

a first section comprising:

a base wall having an opening at a center thereof, and two side walls extending perpendicularly from the base wall, with a plurality of first openings extending through the side walls, and a second section coupled to the first section, the second section comprising a plate with a plurality of second openings configured to align with the first openings to receive fasteners, such that the adjustable bracket is configured for encircling and mounting to a support structure;

a bracket arm connected to the adjustable bracket using a threaded fastener engaged in the base wall opening; and a handrail seat connected to the bracket arm for seating a portion of a handrail therein to connect the handrail to the support structure.

2. The handrail mounting assembly of claim 1 wherein the opening in the base wall comprises a tapped opening for receiving a threaded fastener.

3. The handrail mounting assembly of claim 1, wherein the second section comprises a planar end plate spanning the two side walls.

4. The handrail mounting assembly of claim 1, wherein the bracket arm comprises a tubular barrel having an opening extending therethrough and a handrail seat connector extending perpendicular to the tubular barrel.

5. The handrail mounting assembly of claim 4, further comprising a threaded fastener seated in the opening of the bracket arm the threaded fastener having a head portion seated in a seat in the tubular barrel and a protruding portion protruding from an end of the tubular barrel.

6. The handrail mounting assembly of claim 5, wherein the protruding portion of the threaded fastener is received in a threaded opening in the adjustable bracket to connect the bracket arm to the adjustable bracket.

7. A method of mounting a handrail to a post, comprising the steps of:

providing an adjustable bracket comprising:

a first section comprising a base wall having an opening at a center thereof, and two side walls extending perpendicularly from the base wall, with a plurality of first openings extending through the side walls, and a second section comprising a plate with a plurality of second openings configured to align with the first openings to receive fasteners;

attaching the adjustable bracket to the post by sandwiching the post between first and second sections of the adjustable bracket;

tightening the adjustable bracket to set the position of the adjustable bracket on the post;

orienting a bracket arm relative to the adjustable bracket;

tightening the bracket arm to the adjustable bracket with a fastener to set the orientation of the bracket arm relative to the adjustable bracket; and attaching a handrail to a handrail seat connected to the bracket arm.

8. The method of claim 7, wherein the bracket arm comprises a tubular barrel having an opening extending therethrough and a handrail seat connector extending perpendicular to the tubular barrel.

9. The method of claim 8, wherein the step of tightening the bracket arm comprises tightening a threaded fastener extending through the tubular barrel and into a threaded opening in the adjustable bracket to secure the bracket arm to the adjustable bracket.

* * * * *